US008379004B2

(12) United States Patent
Han et al.

(10) Patent No.: US 8,379,004 B2
(45) Date of Patent: Feb. 19, 2013

(54) PIXEL AND ORGANIC LIGHT EMITTING DISPLAY DEVICE USING THE SAME

(75) Inventors: Sam-Il Han, Yongin (KR); Hyun-Chol Bang, Yongin (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 569 days.

(21) Appl. No.: 12/634,590

(22) Filed: Dec. 9, 2009

(65) Prior Publication Data

US 2010/0201656 A1 Aug. 12, 2010

(30) Foreign Application Priority Data

Feb. 11, 2009 (KR) ..... 10-2009-0011017

(51) Int. Cl.
*G09G 5/00* (2006.01)

(52) U.S. Cl. ..... 345/205; 345/76; 345/690; 345/691

(58) Field of Classification Search ..... 345/690, 345/691, 76
See application file for complete search history.

(56) References Cited

U.S. PATENT DOCUMENTS

| | | | | |
|---|---|---|---|---|
| 7,502,000 | B2 * | 3/2009 | Yuki et al. | 345/77 |
| 2003/0201727 | A1 | 10/2003 | Yamazaki et al. | |
| 2006/0066528 | A1 * | 3/2006 | Hara | 345/76 |
| 2006/0152449 | A1 * | 7/2006 | Norimatu | 345/76 |
| 2006/0221006 | A1 | 10/2006 | Umezaki | |
| 2008/0018570 | A1 | 1/2008 | Gerets | |
| 2008/0111804 | A1 * | 5/2008 | Choi et al. | 345/205 |
| 2008/0211397 | A1 | 9/2008 | Choi | |

FOREIGN PATENT DOCUMENTS

| | | | |
|---|---|---|---|
| EP | 1 923 857 | | 5/2008 |
| JP | 2005-258427 | A | 9/2005 |
| JP | 2005-308868 | A | 11/2005 |
| JP | 2007-133043 | A | 5/2007 |
| JP | 2007-140489 | A | 6/2007 |
| JP | 2008-65311 | A | 3/2008 |
| JP | 2008-122516 | A | 5/2008 |
| JP | 2008-122906 | A | 5/2008 |
| JP | 2008-191450 | A | 8/2008 |
| KR | 10-2006-0078584 | A | 7/2006 |
| KR | 10-0844770 | B1 | 7/2008 |
| KR | 10-0873074 | B1 | 12/2008 |
| KR | 10-0873076 | B1 | 12/2008 |
| WO | WO 2006/067706 | | 6/2006 |

OTHER PUBLICATIONS

Japanese Office Action dated Mar. 27, 2012 for Japanese Patent Application No. JP 2009-093383 which shares priority of Korean Patent Application No. KR 10-2009-0011017 with captioned U.S. Appl. No. 12/634,590.
European Search Report dated May 19, 2010.

(Continued)

*Primary Examiner* — Wayne Young
*Assistant Examiner* — Linh H Hoffner
(74) *Attorney, Agent, or Firm* — Knobbe Martens Olson & Bear LLP

(57) ABSTRACT

A pixel for an organic light emitting diode display is disclosed. The pixel includes an organic light emitting diode, a dummy organic light emitting diode, and a compensator configured to change the current received by the organic light emitting diode according to the difference in threshold voltages of the organic light emitting diode and the dummy organic light emitting diode.

19 Claims, 4 Drawing Sheets

OTHER PUBLICATIONS

Korean Notice of Allowance dated May 25, 2011 for Korean Patent Application No. KR 10-2009-0011017 which corresponds to captioned U.S. Appl. No. 12/634,590.

Japanese Office Action dated Nov. 29, 2011 for Japanese Patent Application No. JP 2009-093383 which shares priority of Korean Patent Application No. KR 10-2009-0011017 with captioned U.S. Appl. No. 12/634,590.

* cited by examiner

PIXEL AND ORGANIC LIGHT EMITTING DISPLAY DEVICE USING THE SAME

CROSS-REFERENCE TO RELATED APPLICATIONS

This application claims priority to and the benefit of Korean Patent Application No. 10-2009-0011017, filed on Feb. 11, 2009, in the Korean Intellectual Property Office, the entire content of which is incorporated herein by reference.

BACKGROUND

1. Field

The field relates to a pixel and an organic light emitting display device using the same, and more particularly, to a pixel capable of compensating for deterioration of an organic light emitting diode and an organic light emitting display device using the pixel.

2. Description of the Related Technology

There are various types of flat panel display devices having reduced weight and volume when compared to cathode ray tubes. The flat panel display devices include liquid crystal display devices, field emission display devices, plasma display panels, organic light emitting display devices, and the like.

An organic light emitting display device displays images using organic light emitting diodes that emit light through recombination of electrons and holes. The organic light emitting display device has a fast response and is driven with low power consumption.

FIG. 1 is a circuit diagram of a pixel of a conventional organic light emitting display device.

Referring to FIG. 1, the pixel 4 of the conventional organic light emitting display device includes an organic light emitting diode OLED and a pixel circuit 2 connected to a data line Dm and a scan line Sn to control the organic light emitting diode OLED.

An anode electrode of the organic light emitting diode OLED is coupled to the pixel circuit 2, and a cathode electrode of the organic light emitting diode OLED is coupled to a second power source ELVSS. The organic light emitting diode OLED emits light having luminance corresponding to current supplied from the pixel circuit 2.

When a scan signal is supplied to the pixel circuit 2 through the scan line Sn, the pixel circuit 2 controls an amount of current supplied to the organic light emitting diode OLED in response to a data signal supplied through the data line Dm. For this purpose, the pixel circuit 2 includes a second transistor M2 coupled between a first power source ELVDD and the organic light emitting diode OLED, a first transistor M1 coupled to the second transistor M2, the data line Dm, and the scan line Sn, and a storage capacitor Cst coupled between a gate electrode and a second electrode of the second transistor M2.

A gate electrode of the first transistor M1 is coupled to the scan line Sn, and a first electrode of the first transistor M1 is coupled to the data line Dm. A second electrode of the first transistor M1 is coupled to one terminal of the storage capacitor Cst. Here, the first electrode is either of a source and a drain electrode, and the second electrode is the other. For example, if the first electrode is a source electrode, the second electrode is a drain electrode. When a scan signal is supplied to the first transistor M1 from the scan line Sn, the first transistor M1 is turned on so that a data signal supplied from the data line Dm is supplied to the storage capacitor Cst. As a result, the storage capacitor Cst stores a voltage corresponding to the data signal.

The gate electrode of the second transistor M2 is coupled to the terminal of the storage capacitor Cst, and a first electrode of the second transistor M2 is coupled to the other terminal of the storage capacitor Cst and the first power source ELVDD. The second electrode of the second transistor M2 is coupled to the anode electrode of the organic light emitting diode OLED. The second transistor M2 controls an amount of current flowing from the first power source ELVDD to the second power source ELVSS via the organic light emitting diode OLED, corresponding to the voltage stored in the storage capacitor Cst. As a result, the organic light emitting diode OLED emits light corresponding to an amount of current supplied from the second transistor M2.

However, in the conventional organic light emitting display device, an image having a desired luminance cannot be displayed due to efficiency variation caused by deterioration of the organic light emitting diode OLED. In other words, the organic light emitting diode deteriorates with time, and accordingly, an image having a desired luminance cannot be displayed. As an organic light emitting diode deteriorates, light having low luminance is emitted from the organic light emitting diode.

SUMMARY OF CERTAIN INVENTIVE ASPECTS

One aspect is a pixel including an organic light emitting diode configured to emit light in response to a data signal, a dummy organic light emitting diode in a non-light emitting state regardless of the data signal, a first transistor coupled to scan and data lines, the first transistor being turned on when a scan signal is supplied to the scan line, a storage capacitor configured to charge a voltage corresponding to the data signal supplied to the data line, a second transistor configured to supply current from a first power source to a second power source through the organic light emitting diode, where the current corresponds to the voltage charged in the storage capacitor, and a compensator coupled between the organic light emitting diode and the dummy organic light emitting diode, the compensator configured to change a voltage at a gate electrode of the second transistor according to deterioration of the organic light emitting diode.

Another aspect is an organic light emitting display device, including pixels coupled to scan lines and data lines, a scan driver configured to sequentially supply a scan signal to the scan lines, and a data driver configured to supply a data signal to the data lines. Each of the pixels includes an organic light emitting diode configured to emit light in response to the data signal, a dummy organic light emitting diode in a non-light emitting state regardless of the data signal, a first transistor coupled to scan and data lines, the first transistor being turned on when a scan signal is supplied to the scan line, a storage capacitor configured to charge a voltage corresponding to the data signal supplied to the data line, a second transistor configured to supply current from a first power source to a second power source through the organic light emitting diode, where the current corresponds to the voltage charged in the storage capacitor, and a compensator coupled between the organic light emitting diode and the dummy organic light emitting diode, the compensator configured to change a voltage at a gate electrode of the second transistor according to deterioration of the organic light emitting diode.

Another aspect is a pixel including an organic light emitting diode configured to emit light in response to a current supplied thereto, a dummy organic light emitting diode, a transistor configured to supply current to the organic light emitting diode based at least in part on a gate voltage, and a compensator configured to change the gate voltage according to the difference in threshold voltages of the organic light emitting diode and the dummy organic light emitting diode.

BRIEF DESCRIPTION OF THE DRAWINGS

The accompanying drawings, together with the specification, illustrate exemplary embodiments, and, together with the description, serve to explain the principles of the present invention.

DETAILED DESCRIPTION OF CERTAIN INVENTIVE EMBODIMENTS

Figure 1:
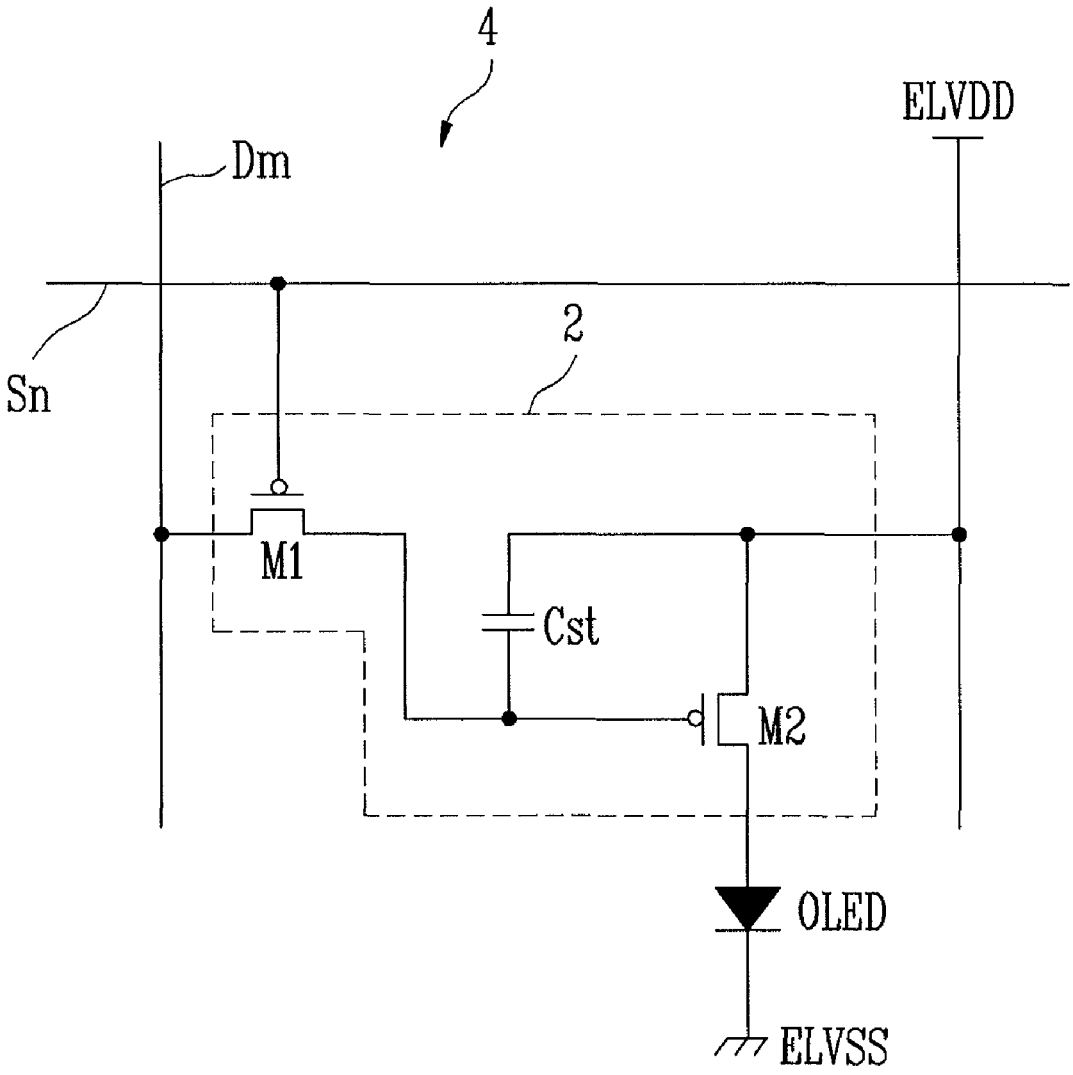
FIG. 1 (PRIOR ART)
FIG. 1 is a circuit diagram of a pixel in a conventional organic light emitting display device.

Hereinafter, certain exemplary embodiments will be described with reference to the accompanying drawings. When a first element is described as being coupled to a second element, the first element may be not only directly coupled to the second element but may also be indirectly coupled to the second element via a third element. Also, like reference numerals generally refer to like elements throughout.

Figure 2:
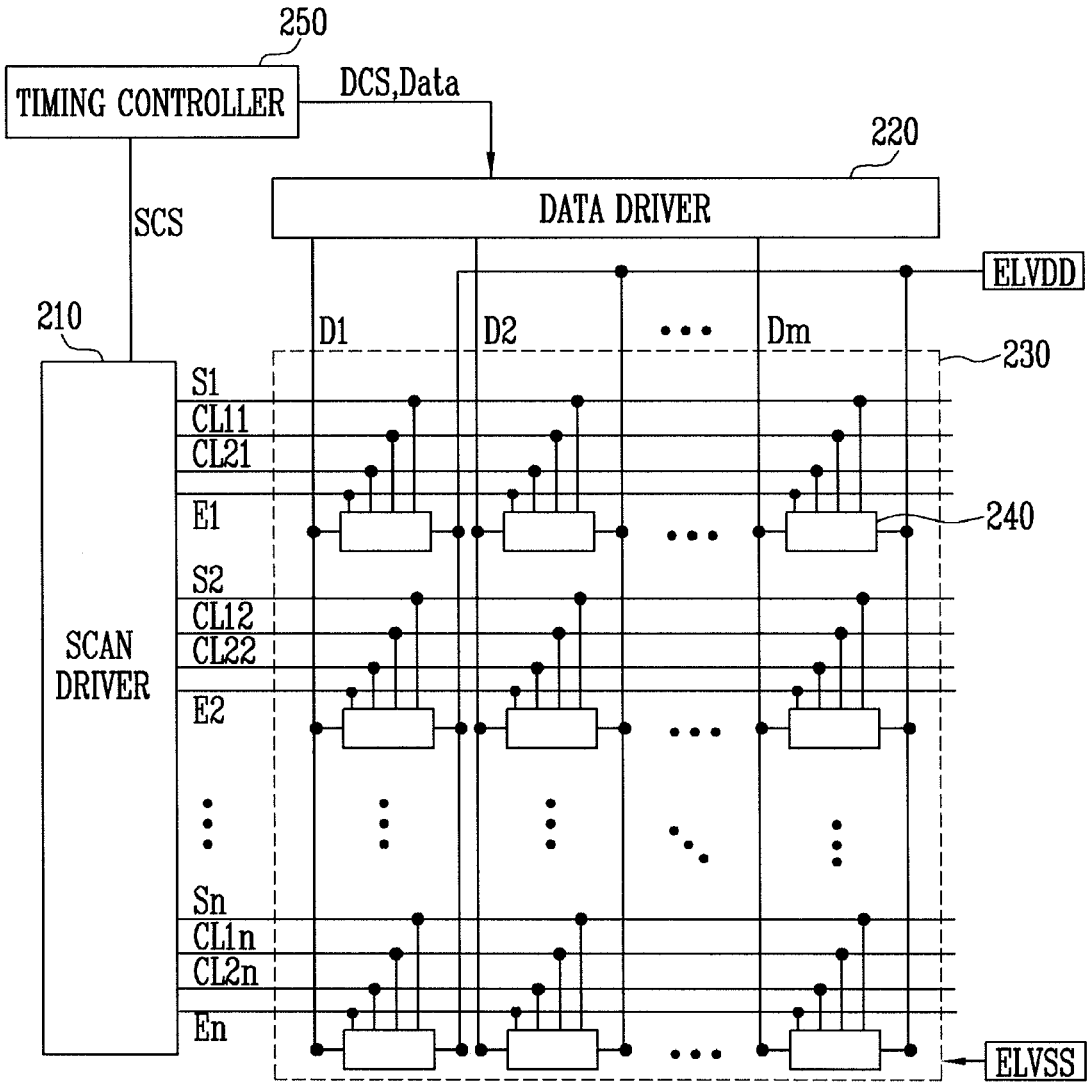
FIG. 2 is a block diagram of an organic light emitting display device according to one embodiment.

FIG. 2 is a block diagram of an organic light emitting display device according to an embodiment.

Referring to FIG. 2, an organic light emitting display device includes a pixel unit 230 including pixels 240 coupled to scan lines S1 to Sn, first control lines CL11 to CL1*n*, second control lines CL21 to CL2*n*, emission control lines E1 to En and data lines D1 to Dm; a scan driver 210 to drive the scan lines S1 to Sn, the first control lines CL11 to CL1*n*, the second control lines CL21 to CL2*n* and the emission control lines E1 to En; a data driver 220 to drive the data lines D1 to Dm; and a timing controller 250 to control the scan driver 210 and the data driver 220.

The scan driver 210 receives a scan driving control signal SCS supplied from the timing controller 250. The scan driver 210 generates a scan signal and sequentially supplies the generated scan signal to the scan lines S1 to Sn. The scan driver 210 generates first and second control signals in response to the scan driving control signal SCS. The scan driver sequentially supplies the generated first control signal to the first control lines CL11 to CL1*n* and sequentially supplies the generated second control signal to the second control lines CL21 to CL2*n*. The scan driver 210 generates an emission control signal and sequentially supplies the generated emission control signal to the emission control lines E1 to En.

Figure 5:
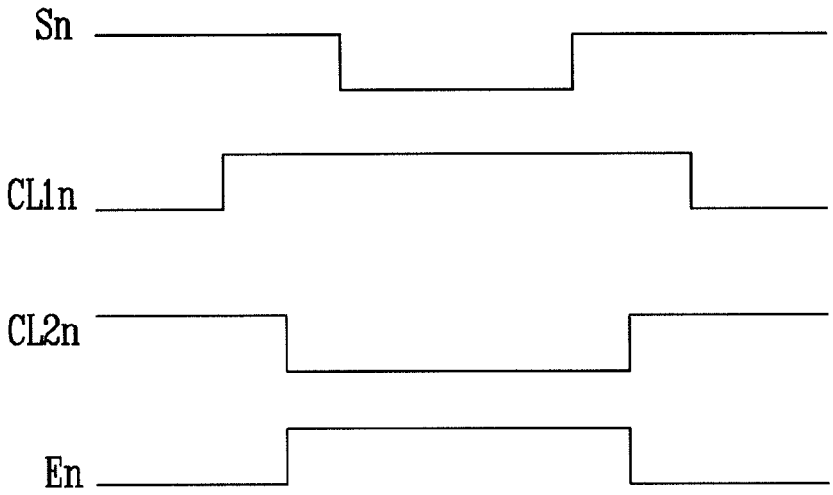
FIG. 5 is a waveform diagram illustrating a method of driving a pixel shown in FIG. 4.

An embodiment of a drive scheme is shown in FIG. 5. The emission control signal is wider than the scan signal. The emission control signal supplied to an i-th ("i" is a natural number) emission control line Ei overlaps the scan signal supplied to an i-th scan line Si. The first control signal supplied to an i-th first control line CL1*i* is wider than the emission control signal and overlaps the emission control signal supplied to the i-th emission control line Ei. The second control signal supplied to an i-th second control line CL2*i* is simultaneously supplied to have the same width as that of the emission control signal and has an opposite polarity to that of the emission control signal.

The first control lines CL11 to CL1*n* and the second control lines CL21 to CL2*n* may be omitted depending on the structure of pixels 240.

The data driver 220 receives a data driving control signal DCS supplied from the timing controller 250. The data driver 220 generates data signals and supplies the generate data signals to the data lines D1 to Dm in synchronization with scan signals.

The timing controller 250 generates a data driving control signal DCS and a scan driving control signal SCS in response to synchronization signals supplied thereto. The data driving control signal DCS generated from the timing controller 250 is supplied to the data driver 220, and the scan driving control signal SCS generated from the timing controller 250 is supplied to the scan driver 210. The timing controller 250 supplies data Data supplied from the outside to the data driver 220.

The pixel unit 230 receives a first power source ELVDD and a second power source ELVSS, and supplies the first power source ELVDD and the second power source ELVSS to each of the pixels 240. Each of the pixels 240 receiving the first power source ELVDD and the second power source ELVSS generates light in response to a data signal. Each of the pixels 240 is provided with a compensator (not shown) to compensate for deterioration of an organic light emitting diode.

Figure 3:
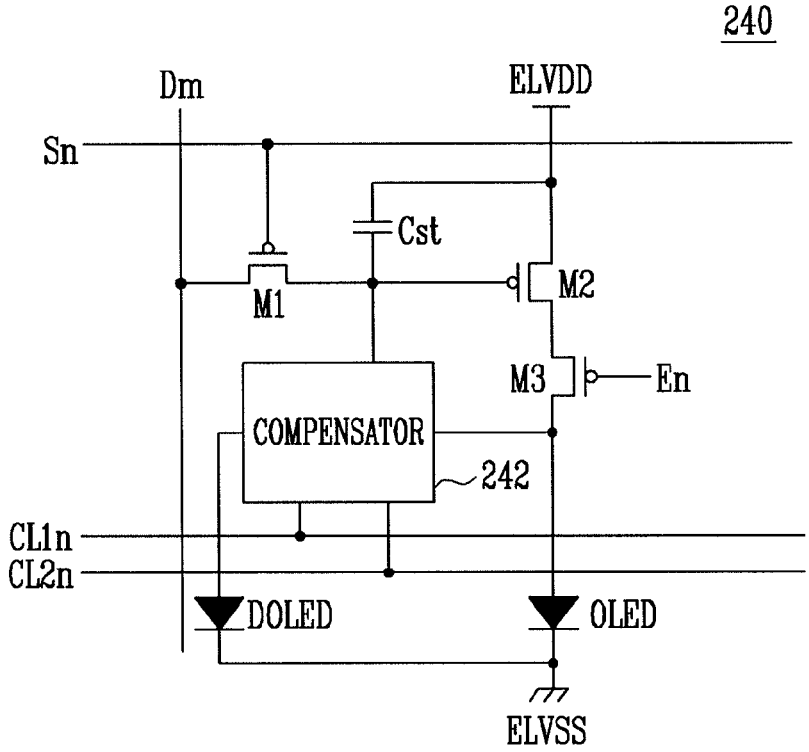
FIG. 3 is a circuit diagram showing an embodiment of a pixel shown in FIG. 2.

FIG. 3 is a circuit diagram of a pixel according to one embodiment. For convenience of illustration, a pixel coupled to an n-th scan line Sn and an m-th data line Dm is shown in FIG. 3.

Referring to FIG. 3, in this embodiment, the pixel 240 includes an organic light emitting diode OLED; a first transistor M1 coupled to a scan line Sn and a data line Dm; a second transistor M2 controlling an amount of current supplied to the organic light emitting diode OLED corresponding to a voltage charged in a storage capacitor Cst; a third transistor M3 coupled between the organic light emitting diode OLED and the second transistor M2; and a compensator 242 coupled between the organic light emitting diode OLED and a dummy organic light emitting diode DOLED so as to compensate for deterioration of the organic light emitting diode OLED.

An anode electrode of the organic light emitting diode OLED is coupled to the third transistor M3, and a cathode electrode of the organic light emitting diode OLED is coupled to the second power source ELVSS. The organic light emitting diode OLED emits light having a luminance corresponding to current supplied via the second transistor and the third transistor M3.

A gate electrode of the first transistor M1 is coupled to the scan line Sn, and a first electrode of the first transistor M1 is coupled to the data line Dm. A second electrode of the first transistor M1 is coupled to a gate electrode of the second transistor M2 (driving transistor). When a scan signal is supplied to the scan line Sn, the first transistor M1 supplies a data signal supplied to the data line Dm to the gate electrode of the second transistor M2.

The gate electrode of the second transistor M2 is coupled to the second electrode of the first transistor M1, and a first electrode of the second transistor M2 is coupled to a first power source ELVDD. A second electrode of the second transistor M2 is coupled to a first electrode of the third transistor M3. The second transistor M2 controls an amount of current flowing from the first power source ELVDD to the second power source ELVSS through the organic light emitting diode OLED, corresponding to the voltage applied to the gate electrode of the second transistor M2.

A gate electrode of the third transistor M3 is coupled to an emission control line En, and the first electrode of the third transistor M3 is coupled to the second electrode of the second transistor M2. A second electrode of the third transistor M3 is coupled to an anode electrode of the organic light emitting diode OLED. When an emission control signal is supplied from the emission control line En, the third transistor M3 is turned off. In other cases, the third transistor M3 is turned on. The third transistor M3 is turned off during at least a period when a scan signal is supplied so that the pixel 240 is in a non-light emission state.

One terminal of the storage capacitor Cst is coupled to the gate electrode of the second transistor M2, and the other terminal of the storage capacitor Cst is coupled to the first power source ELVDD. When the first transistor M1 is turned on, a voltage corresponding to the data signal is charged in the storage capacitor Cst.

The compensator 242 is coupled between the dummy organic light emitting diode DOLED and the organic light emitting diode OLED. The compensator 242 controls the voltage at the gate electrode of the second transistor M2 so as to compensate for the deterioration of the organic light emitting diode OLED.

Figure 4:
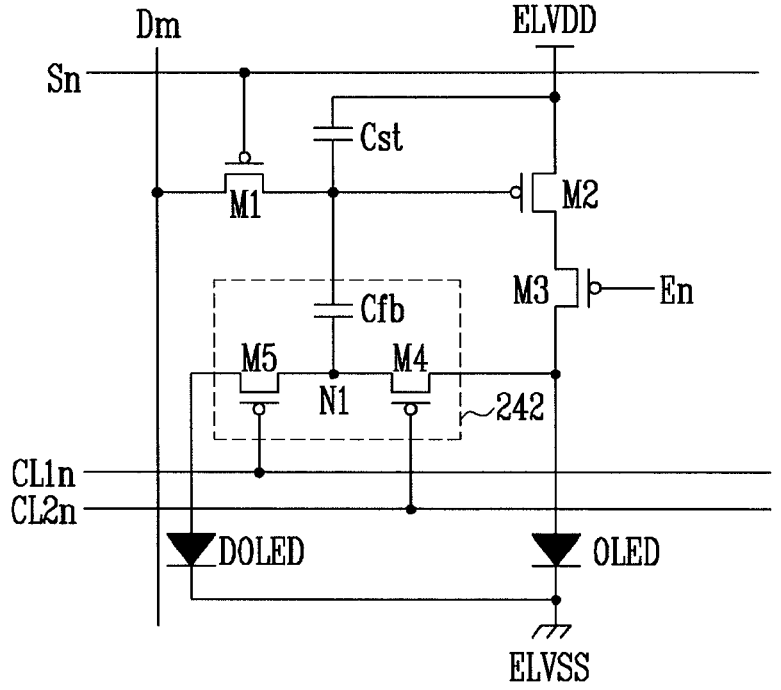
FIG. 4 is a circuit diagram showing an embodiment of a compensator shown in FIG. 3.

FIG. 4 is a circuit diagram showing a first embodiment of the compensator shown in FIG. 3.

Referring to FIG. 4, the compensator 242 according to one embodiment includes fourth and fifth transistors M4 and M5 coupled between the organic light emitting diode OLED and the dummy organic light emitting diode DOLED; and a feedback capacitor Cfb coupled between a first node N1 and the gate electrode of the second transistor M2.

The fourth transistor M4 is coupled between the first node N1 and the anode electrode of the organic light emitting diode OLED and is controlled by the second control signal supplied from a second control line CL2*n*.

The fifth transistor M5 is coupled between the first node N1 and the dummy organic light emitting diode DOLED and is controlled by the first control signal supplied from a first control line CL1*n*. The fourth and fifth transistors M4 and M5 are used to supply a voltage to the first node N1, and the turned-on times of the fourth and fifth transistors M4 and M5 do not overlap. For example, the fourth and fifth transistors M4 and M5 are alternately turned on to control the voltage at the first node N1.

The feedback capacitor Cfb couples a voltage variation at the first node N1 to the gate electrode of the second transistor M2.

FIG. 5 is a waveform diagram illustrating a method of driving the pixel shown in FIG. 4.

An operation of the pixel 240 shown in FIG. 4 will be described in conjunction with FIGS. 4 and 5. First, a first control signal (high voltage) is supplied to the first control line CL1*n*, and the fifth transistor is off. Because the fifth transistor M5 is turned off, the first node N1 and the dummy organic light emitting diode DOLED are electrically isolated.

While the fifth transistor M5 is off, a second control signal (low voltage) is supplied to the second control line CL2*n*, and an emission control signal (high voltage) is simultaneously supplied to the emission control line En. Because the emission control signal is supplied to the emission control line En, the third transistor M3 is off. Because the second control signal is supplied to the second control line CL2*n*, the fourth transistor M4 is on, and the threshold voltage Vth1 of the organic light emitting diode OLED is supplied to the first node N1. That is, since the third transistor M3 is turned off, the threshold voltage Vth1 of the organic light emitting diode OLED is supplied to the first node N1.

Thereafter, a scan signal is supplied to the scan line Sn, and the first transistor M1 is turned on. Because the first transistor M1 is on, a voltage corresponding to a data signal supplied to the data line Dm is charged in the storage capacitor Cst. After the voltage corresponding to the data signal is charged in the storage capacitor Cst, the scan signal is suspended, and the first transistor M1 is turned off.

After the first transistor M1 is turned off, the second control signal and the emission control signal is suspended. Because the second control signal is suspended, the fourth transistor M4 is turned off. Because the emission control signal is suspended, the third transistor M3 is turned on.

Thereafter, the first control signal is suspended, and the fifth transistor M5 is turned on. Because the fifth transistor is turned on, the voltage at the first node N1 changes to the threshold voltage Vth2 of the dummy organic light emitting diode DOLED. The amount of change is determined by the difference between the threshold voltage Vth1 of the organic light emitting diode OLED and the threshold voltage Vth2 of the dummy organic light emitting diode DOLED. The difference between the thresholds is determined by the deterioration of the organic light emitting diode OLED.

The deterioration of the organic light emitting diode OLED corresponds to its emission time. When the organic light emitting diode OLED deteriorates, the threshold voltage Vth1 of the organic light emitting diode OLED changes. The voltage Vth1 of the organic light emitting diode OLED generally rises.

Meanwhile, the dummy organic light emitting diode DOLED maintains a non-emission state regardless of the data signal. Therefore, the dummy organic light emitting diode DOLED does not deteriorate, and maintains the initial threshold voltage Vth2. Accordingly, when the threshold voltage Vth2 of the dummy organic light emitting diode DOLED is supplied to the first node N1, the voltage at the first node N1 drops from the voltage Vth1 of the organic light emitting diode OLED to the threshold voltage Vth2 of the dummy organic light emitting diode DOLED.

Because the voltage at the first node N1 drops, the voltage at the gate electrode of the second transistor M2 also drops. The reduction of the voltage at the gate electrode of the second transistor M2 is approximated by Equation 1.

$$\Delta V_{M2_gate} = \Delta V_{N1} \times (C_{fb}/(C_{st}+C_{fb})) \quad (1)$$

In Equation 1, $\Delta V_{M2_gate}$ denotes a variation of the voltage at the gate electrode of the second transistor M2, and $\Delta V_{N1}$ denotes a variation of the voltage at the first node N1.

Referring to Equation 1, the gate electrode of the second transistor M2 is changed corresponding to the variation of the voltage at the first node N1. That is, when the voltage at the first node N1 drops, the voltage at the gate electrode of the second transistor M2 also drops. Thereafter, the second transistor M2 supplies current corresponding to the voltage applied to the gate electrode of the second transistor M2 from the first power source ELVDD to the second power source ELVSS through the organic light emitting diode OLED. As a result, light corresponding to the current is emitted from the organic light emitting diode OLED.

With continued use, the threshold voltage Vth1 of the organic light emitting diode OLED rises according to the deterioration of the organic light emitting diode OLED. If the threshold voltage Vth1 of the organic light emitting diode OLED rises, the voltage at the first node N1 is further reduced.

If the reduction of the voltage at the first node N1 increases, the reduction of the voltage at the gate electrode of the second transistor M2 increases, as expressed by Equation 1. As a result, an amount of current supplied to the second transistor M2 increases according to the same data signal. That is, as the organic light emitting diode OLED is deteriorated, the amount of current supplied to the second transistor M2 is increased, thereby compensating for luminance degraded by the deterioration of the organic light emitting diode OLED.

Because the dummy organic light emitting diode DOLED coupled to the second ELVSS is used, the voltage at the gate electrode of the second transistor M2 can be controlled regardless of a possible voltage change in the second power source ELVSS. The variation of the voltage at the first node N1 is expressed by Equation 2.

$$\Delta V_{N1}=(ELVSS+Vth1)-(ELVSS+Vth2) \quad (2)$$

In Equation 2, $\Delta V_{N1}$ denotes a variation of the voltage at the first node N1.

Referring to Equation 2, the variation of the voltage at the first node N1 is determined by the threshold voltage Vth1 of the organic light emitting diode OLED and the threshold voltage Vth2 of the dummy organic light emitting diode DOLED, and is independent of the voltage of the second power source ELVSS. Accordingly, the voltage at the gate electrode of the second transistor M2 can be adjusted using the voltage corresponding to the deterioration of the organic light emitting diode OLED, regardless of the voltage drop of the second power source ELVSS.

Figure 6:
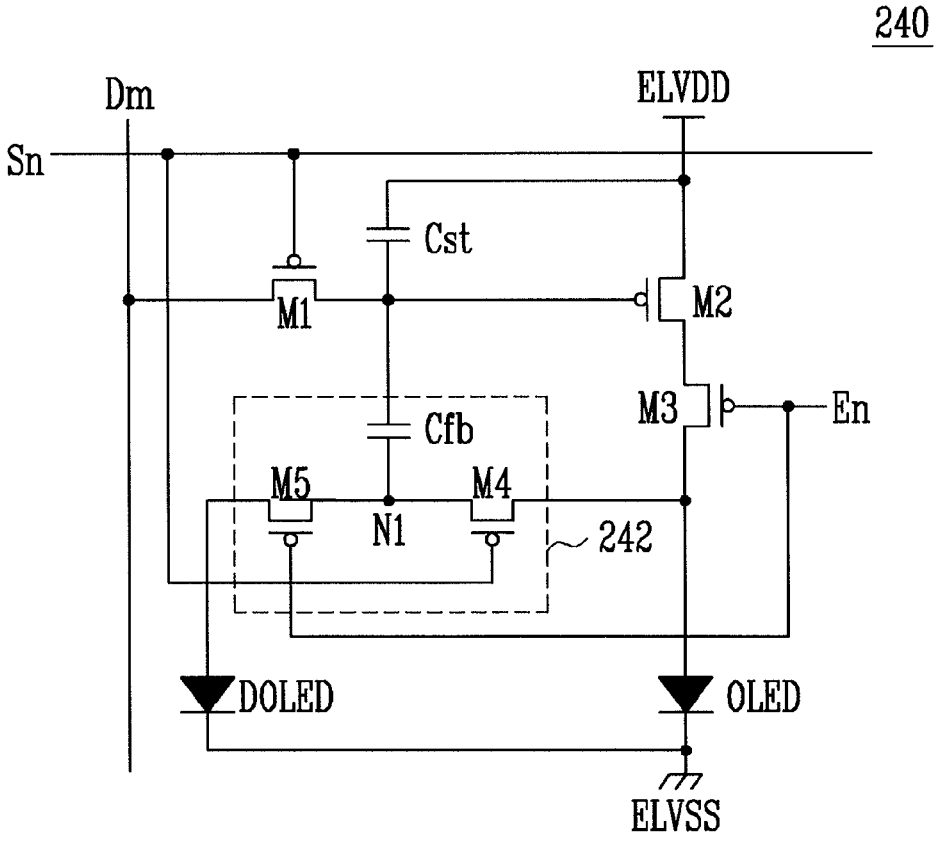
FIG. 6 is a circuit diagram showing another embodiment of the compensator shown in FIG. 3.

FIG. 6 is a circuit diagram showing a second embodiment of the compensator shown in FIG. 3. In FIG. 6, detailed descriptions for certain aspects of some components similar to those of FIG. 4 will be omitted.

Referring to FIG. 6, the compensator 242 includes fourth and fifth transistors M4 and M5 coupled between the dummy organic light emitting diode DOLED and the organic light emitting diode OLED; and a feedback capacitor Cfb coupled between the first node N1 and the gate electrode of the second transistor M2.

The fourth transistor M4 is coupled between the first node N1 and the anode electrode of the organic light emitting diode OLED. The fourth transistor M4 is controlled by the scan signal supplied from the scan line Sn.

The fifth transistor M5 is coupled between the first node N1 and the dummy organic light emitting diode DOLED. The fifth transistor M5 is controlled by the emission control signal supplied from the emission control line En.

In the compensator 242 according to the embodiment of FIG. 6, the first and second control lines CL1*n* and CL2*n* can be removed as compared with the compensator 242 shown in FIG. 4. This is achieved because the compensator 242 of FIG. 6 is coupled to the scan line Sn and the emission control line En to compensate for deterioration of the organic light emitting diode OLED.

Operation of the pixel 240 will be described using the scan signal and the emission control signal, shown in FIG. 5. First, the emission control signal is supplied to the emission control line En. Because the emission control signal is supplied to the emission control line En, the third and fifth transistors M3 and M5 are turned off when the emission control signal is high.

The scan signal is supplied to the scan line Sn, and the first and fourth transistors M1 and M4 are turned on. Because the first transistor M1 is turned on, a voltage corresponding to a data signal supplied to the data line Dm is charged in the storage capacitor Cst. Because the fourth transistor M4 is turned on, the threshold voltage Vth1 of the organic light emitting diode OLED is supplied to the first node N1. After the voltage corresponding to the data signal is charged in the storage capacitor Cst, the supply of the scan signal is suspended, and the first and fourth transistors M1 and M4 are turned off.

After the first and fourth transistors M1 and M4 are turned off, the supply of the emission control signal to the emission control line En is suspended. Because the supply of the emission control signal is suspended, the fifth transistor M5 is turned on, and the voltage at the first node N1 drops to the threshold voltage Vth2 of the dummy organic light emitting diode DOLED. Because the voltage at the first node N1 drops to the threshold voltage Vth2 of the dummy organic light emitting diode DOLED, the voltage at the gate electrode of the second transistor M2 also drops as expressed by Equation 1. Here, since the reduction of the voltage at the gate electrode of the second transistor M2 is determined according to the deterioration of the organic light emitting diode OLED, the deterioration of the organic light emitting diode OLED is compensated.

The structure of the pixel 240 is not limited to those of FIGS. 4 and 6. A compensator 242 can be applied to various types of pixel circuits.

While certain inventive embodiments have been described, it is to be understood that the invention is not limited to the disclosed embodiments, but, on the contrary, is intended to cover various modifications and equivalent arrangements.

What is claimed is:

1. A pixel comprising:

an organic light emitting diode configured to emit light in response to a data signal;

a dummy organic light emitting diode in a non-light emitting state regardless of the data signal;

a first transistor coupled to scan and data lines, the first transistor being turned on when a scan signal is supplied to the scan line;

a storage capacitor configured to charge a voltage corresponding to the data signal supplied to the data line;

a second transistor configured to supply current from a first power source to a second power source through the organic light emitting diode, wherein the current corresponds to the voltage charged in the storage capacitor; and a compensator coupled between the organic light emitting diode and the dummy organic light emitting diode, the compensator configured to change a voltage at a gate electrode of the second transistor according to deterioration of the organic light emitting diode, wherein the compensator comprises a capacitor, and wherein the capacitor is configured to capacitively couple the difference in threshold voltages of the organic light emitting diode and the dummy organic light emitting diode to the gate electrode of the second transistor.

2. The pixel of claim 1, further comprising a third transistor coupled between the second transistor and the organic light emitting diode, the second transistor being turned off at least while the scan signal is supplied.

3. The pixel of claim 2, wherein the third transistor is coupled to an emission control line, wherein the third transistor is turned off when an emission control signal is supplied to the emission control line.

4. The pixel of claim 3, wherein the emission control signal is wider than the scan signal, and overlaps the scan signal.

5. The pixel of claim 2, wherein the compensator comprises:

fourth and fifth transistors coupled between the organic light emitting diode and the dummy organic light emitting diode; and a feedback capacitor coupled between the gate electrode of the second transistor and a node of the fourth and fifth transistors.

6. The pixel of claim 5, wherein the turned-on times of the fourth and fifth transistors do not overlap.

7. The pixel of claim 6, wherein the fourth transistor is turned on during a period when the voltage corresponding to the data signal is charged in the storage capacitor and when a threshold voltage of the organic light emitting diode is supplied to the node.

8. The pixel of claim 7, wherein the fifth transistor is turned on during a period when the fourth transistor is turned off and when a threshold voltage of the dummy organic light emitting diode is supplied to the node.

9. An organic light emitting display device, comprising:

pixels coupled to scan lines and data lines;

a scan driver configured to sequentially supply a scan signal to the scan lines; and a data driver configured to supply a data signal to the data lines, wherein each of the pixels comprises:

an organic light emitting diode configured to emit light in response to the data signal;

a dummy organic light emitting diode in a non-light emitting state regardless of the data signal;

a first transistor coupled to scan and data lines, the first transistor being turned on when a scan signal is supplied to the scan line;

a storage capacitor configured to charge a voltage corresponding to the data signal supplied to the data line;

a second transistor configured to supply current from a first power source to a second power source through the organic light emitting diode, wherein the current corresponds to the voltage charged in the storage capacitor; and a compensator coupled between the organic light emitting diode and the dummy organic light emitting diode, the compensator configured to change a voltage at a gate electrode of the second transistor according to deterioration of the organic light emitting diode, wherein the compensator comprises a capacitor, and wherein the capacitor is configured to capacitively couple the difference in threshold voltages of the organic light emitting diode and the dummy organic light emitting diode to the gate electrode of the second transistor.

10. The organic light emitting display device of claim 9, further comprising a third transistor coupled between the second transistor and the organic light emitting diode, the second transistor being turned off at least while the scan signal is supplied to the scan line.

11. The organic light emitting display device of claim 10, wherein the third transistor is coupled to an emission control line, wherein the third transistor is turned off when an emission control signal is supplied to the emission control line.

12. The organic light emitting display device of claim 11, wherein the scan driver is configured to supply the emission control signal being wider than the scan signal.

13. The organic light emitting display device of claim 10, wherein the compensator comprises:

fourth and fifth transistors coupled between the organic light emitting diode and the dummy organic light emitting diode; and a feedback capacitor coupled between the gate electrode of the second transistor and a node of the fourth and fifth transistors.

14. The organic light emitting display device of claim 13, wherein the turned-on times of the fourth and fifth transistors do not overlap.

15. The organic light emitting display device of claim 14, wherein the fourth transistor is turned on during a period when the voltage corresponding to the data signal is charged in the storage capacitor and when a threshold voltage of the organic light emitting diode is supplied to the common node.

16. The organic light emitting display device of claim 15, wherein the fifth transistor is turned on during a period when the fourth transistor is turned off and when a threshold voltage of the dummy organic light emitting diode is supplied to the node.

17. A pixel comprising:

an organic light emitting diode configured to emit light in response to a current supplied thereto;

a dummy organic light emitting diode;

a transistor configured to supply current to the organic light emitting diode based at least in part on a gate voltage; and a compensator configured to change the gate voltage according to the difference in threshold voltages of the organic light emitting diode and the dummy organic light emitting diode, wherein the compensator comprises a capacitor, and wherein the capacitor is configured to capacitively couple the difference in threshold voltages of the organic light emitting diode and the dummy organic light emitting diode to the gate voltage.

18. The pixel of claim 17, wherein the capacitor receives the threshold voltage of the organic light emitting diode according to a first signal, and receives the threshold voltage of the dummy organic light emitting diode according to a second signal.

19. The pixel of claim 18, wherein the first signal is a scan signal and the second signal is an emission control signal.

* * * * *